US008920579B2

(12) United States Patent
Liedtke

(10) Patent No.: US 8,920,579 B2
(45) Date of Patent: Dec. 30, 2014

(54) BURNER CLEANING DEVICE

(75) Inventor: Ralf Liedtke, Oberhausen (DE)

(73) Assignee: Siemens Aktiengesellschaft, München (DE)

( * ) Notice: Subject to any disclaimer, the term of this patent is extended or adjusted under 35 U.S.C. 154(b) by 1425 days.

(21) Appl. No.: 12/310,144

(22) PCT Filed: Aug. 10, 2007

(86) PCT No.: PCT/EP2007/058299

§ 371 (c)(1),
(2), (4) Date: Feb. 12, 2009

(87) PCT Pub. No.: WO2008/019995

PCT Pub. Date: Feb. 21, 2008

(65) Prior Publication Data

US 2009/0320891 A1 Dec. 31, 2009

(30) Foreign Application Priority Data

Aug. 16, 2006 (EP) ..... 06017057

(51) Int. Cl.
*B08B 9/00* (2006.01)
*F23D 11/38* (2006.01)

(52) U.S. Cl.
CPC ..... *F23D 11/386* (2013.01)
USPC ..... 134/166 R

(58) Field of Classification Search
USPC ..... 134/166 R
See application file for complete search history.

(56) References Cited

U.S. PATENT DOCUMENTS

| | | | | |
|---|---|---|---|---|
| 3,667,487 | A * | 6/1972 | Schoenbeck et al. | 134/108 |
| 4,672,988 | A * | 6/1987 | Tash | 134/167 C |
| 4,995,915 | A | 2/1991 | Sewell et al. | |
| 5,020,188 | A * | 6/1991 | Walton | 15/406 |
| 5,038,810 | A * | 8/1991 | Pacheco et al. | 134/167 R |
| 5,062,792 | A * | 11/1991 | Maghon | 431/284 |
| 7,198,052 | B2 * | 4/2007 | Watt | 134/22.1 |

FOREIGN PATENT DOCUMENTS

| | | | |
|---|---|---|---|
| CN | 1519466 | A | 8/2004 |
| CN | 1526927 | A | 9/2004 |
| EP | 0636767 | A1 | 2/1995 |
| EP | 1452802 | A1 | 9/2004 |
| EP | 1574675 | A2 | 9/2005 |
| SU | 1775188 | A1 | 11/1992 |
| SU | 1815404 | A1 | 5/1993 |

* cited by examiner

*Primary Examiner* — Michael Barr
*Assistant Examiner* — Jason Riggleman

(57) ABSTRACT

A burner cleaning device for cleaning burners, in particular for gas turbine burners, with a fuel nozzle and a fuel supply line is disclosed. The burner cleaning device has a rinsing head provided with an opening that is placed on a fuel nozzle of the burner and that enables a rinsing fluid to be supplied to or evacuated from the nozzle, and/or a fluid line that is connected to the fuel supply line of the burner and that enables the rinsing fluid to be supplied to or evacuated from the fuel supply line, and a pump. The pump, the rinsing head and/or the fluid line are fluidically interconnected such that they form a flow path through which the rinsing fluid sequentially flows.

12 Claims, 5 Drawing Sheets

BURNER CLEANING DEVICE

CROSS REFERENCE TO RELATED APPLICATIONS

This application is the U.S. National Stage of International Application No. PCT/EP2007/058299 filed Aug. 10, 2007 and claims the benefit thereof. The International Application claims the benefits of European application No. 06017057.8 EP filed Aug. 16, 2006, both of the applications are incorporated by reference herein in their entirety.

FIELD OF INVENTION

The present invention relates to a burner cleaning device for cleaning burners, in particular for cleaning gas turbine burners having at least one fuel nozzle and at least one fuel supply line.

BACKGROUND OF INVENTION

Soiling or coking can occur particularly in the region of the burner nozzles while burners are being operated by means of heating oil. The burner will consequently cease being able to perform at fill capacity. Excessive soiling or coking can furthermore damage burner components. A drop in performance due to soiling or coking of the burner is detrimental in the case particularly of gas turbines because the gas turbine's overall performance and emission values are negatively affected thereby.

When impurities are detected in gas turbine burners, the burner nozzles are at present broken through by hand. Blow-out runs then have to be carried out on the gas turbine during which any dirt residues will be blown out of the nozzles.

Furthermore, gas turbine burners are frequently provided with annular spaces that duct the heating oil from a central heating oil supply line to fuel nozzles arranged annularly around a central burner part. The annular space sited inside the burner cannot be cleaned using the cited means. If the burner's operational restrictions cannot be eliminated by breaking through the nozzles, the nozzles will have to be removed. Only then can the annular space be cleaned, though that can be done only to a limited extent. The removed nozzles can then be cleaned in a cleaning bath as is described in, for example, EP 0 636 767 A1. More extensive cleaning will require complete dismantling of the burner.

An apparatus for washing an air supply channel in a gas turbine burner is described in EP 1 452 802 A1. The apparatus includes a nozzle body having a discharge end in which is located an annular nozzle assembly that can be arranged opposite the likewise annular air supply channel. By spraying a fluid into the air supply channel through the annular nozzle assembly the latter can be cleaned of residues. For being secured to the burner the apparatus furthermore includes a rod that projects beyond the nozzle body's discharge end and has an annular flange arranged at a distance from the nozzle body. For performing a washing operation from inside the combustion chamber the nozzle body is applied against the burner's air supply channel and the rod ducted through the burner as far as its other end. The assembly is then fixed into position by means of a tensioning bolt by tensioning the nozzle body and flange against mutually opposite ends of the burner.

A mobile flushing unit is described in EP 1 574 675 A2. It includes flexible hoses requiring to be secured to opposite ends of a workpiece. Compressed air and a cleaning fluid can then be pumped through the flexible hoses and the workpiece located between them.

U.S. Pat. No. 4,995,915 discloses a system for cleaning dirty gas firing nozzles in gas turbines, in which system a cleaning chemical is added to the gas while the gas turbine is operating.

SUMMARY OF INVENTION

An object of the present invention is to provide a device for cleaning burners, in particular gas turbine burners, which enables the burner to be cleaned without dismantling it.

Said object is achieved by means of a burner cleaning device as claimed in the independent claim. The dependent claims contain advantageous embodiments of the inventive burner cleaning device.

The burner cleaning device for cleaning burners having at least one fuel nozzle and at least one fuel supply line, in particular for cleaning gas turbine burners, includes at least one rinsing head having at least one rinsing head opening and further includes at least one fluid line and at least one pump. The rinsing head is embodied such that it can be placed by its rinsing head opening onto a fuel nozzle of the burner and will enable a rinsing fluid to be fed to or evacuated from the nozzle. The fluid line is embodied such that it can be connected to the burner's fuel supply line and will enable a rinsing fluid to be fed to or evacuated from the fuel supply line. The pump, rinsing head and fluid line are fluidically interconnected such as to form a flow path along which the rinsing fluid is to sequentially flow.

By means of the pump, rinsing fluid can be introduced under pressure by way of the rinsing head through the fuel nozzle into the fuel supply system, which will cause the fuel supply system to be rinsed. The rinsing fluid can then exit the fuel supply system again via the fuel supply line. Alternatively, it is possible to duct the rinsing fluid via the fuel supply line instead of via the fuel nozzle and allow it to exit again via the nozzle. A closed rinsing circuit can furthermore be established by means of the rinsing head and fluid line.

The burner cleaning device will enable the entire fuel supply system to be cleaned through pressure rinsing by means of the rinsing liquid. Manual cleaning will no longer be necessary. Internal sections of the fuel supply system, for example annular spaces, can furthermore be cleaned at the same time. It will hence no longer be absolutely necessary to dismantle the burners for complete cleaning. Post-cleaning blow-out runs can largely be dispensed with because any dirt residues will be carried away by the rinsing liquid during rinsing and so not remain in the fuel supply system.

This has the advantage that it is therefore not necessary to disassemble the burner in order to perform the rinsing operation by means of the rinsing head. The burner cleaning device also has the advantage that the rinsing device does not have to held in position from the rear (exterior). This, however, has precisely the advantage that a rinsing operation can be effected from the side that is easy to access, namely from the combustion chamber, without any modification whatsoever, which is to say also without having to pay attention to e.g. supply channels. There is therefore no requirement to disassemble the burner and the rinsing device does not have to be held in position from the rear (exterior), but instead a fixing in position from the easy side, i.e. the combustion chamber side, is sufficient.

The device is suitable particularly for cleaning heating oil supply systems of gas turbine burners.

To prevent rinsing fluid from escaping at the transition between the rinsing path formed from the pump, rinsing head and fluid line and the burner, the rinsing head is in one embodiment of the invention provided with at least one seal surrounding the rinsing head opening. The seal is embodied and arranged on the rinsing head such as to surround the nozzle opening when the rinsing head has been placed onto the fuel nozzle. The sealing effect can be intensified if the rinsing head has a tensioning device by means of which it can be tensioned against the nozzle opening. The rinsing head can furthermore be fixed into position on the burner through tensioning of said kind.

In particular the rinsing head can include a wall that is cylindrical or shaped like a truncated cone. The tensioning device can then be embodied as a device located on the wall's exterior and producing pressure, in the form of, say, a compression spring. The rinsing head can in that case simply be inserted into the burner through the burner discharge opening and fixed into position utilizing the existing burner walls solely from the front side of the burner through tensioning against a wall surrounding the burner discharge opening. It will not then be necessary to access the burner from its rear side facing away from the combustion chamber in order to fix the rinsing head into position on the burner.

As an alternative to the compression spring an inflatable hose can also serve as a pressure producing device. That would offer the additional advantage of its also being able to assume a sealing function. It could furthermore be matched to the geometry of the burner wall particularly in the region of the burner discharge opening.

In an advantageous development of the burner cleaning device a filter is connected into the flow path formed from the pump, rinsing head and fluid line. The filter enables insoluble dirt residues carried away by the rinsing fluid to be filtered out. The filtered rinsing fluid can then be re-used for another rinsing operation, which in particular makes a closed rinsing circuit possible.

In particular the burner cleaning device can furthermore include a tank connected into the flow path and serving as a rinsing fluid buffer. In the case of a closed rinsing circuit the tank can serve as a rinsing fluid reservoir.

The burner cleaning device advantageously further includes a valve connected into the flow path. Said valve will enable the flow path to be blocked if necessary. If the flow path leads back to the valve and said valve has at least two valve positions releasing the flow path, with the rinsing fluid's flow direction through the rinsing head and/or fluid line being in one releasing valve position opposite the flow direction in the other releasing valve position, it will be possible by switching the valve over to reverse the rinsing fluid's flow direction through the burner's fuel supply system. That will enable, for example, dirt residues that are too large to pass through the nozzle opening to be removed through the fuel supply line. In the case of a closed rinsing circuit it advantageously also has a section through which fluid always flows in the same direction. The filter will then be located in that section so that dirt residues will not return to the fuel supply system when the flow direction is reversed.

BRIEF DESCRIPTION OF THE DRAWINGS

Further features, characteristics and advantages of the present invention will emerge from the following description of an exemplary embodiment with reference made to the attached figures.

DETAILED DESCRIPTION OF INVENTION

Figure 1:
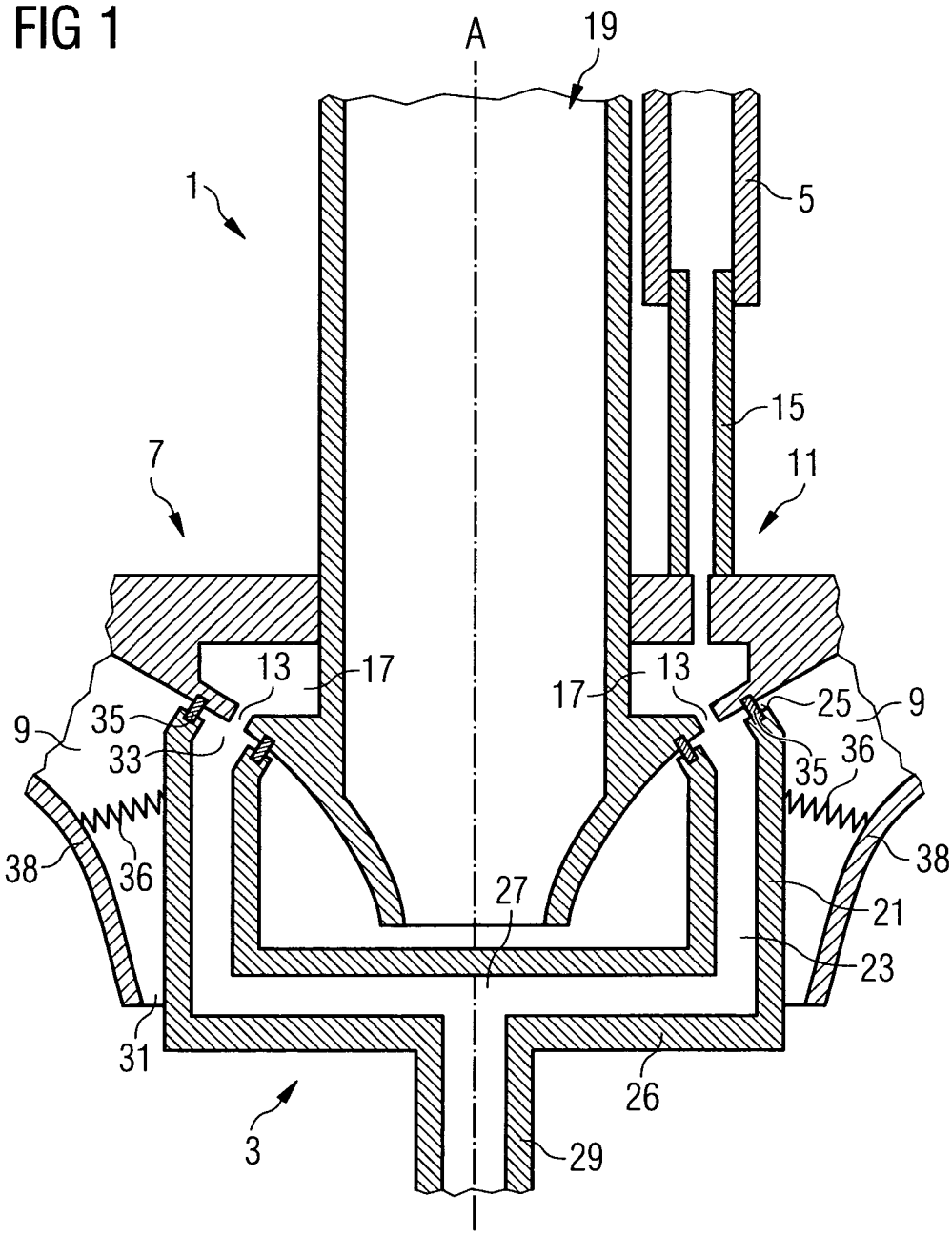
FIG. 1 is a schematic sectional view of a gas turbine burner with elements of a burner cleaning device attached to it.

FIG. 1 shows a gas turbine burner 1 on which are located a rinsing head 3 and a fluid line 5 of a burner cleaning device. The burner 1, rinsing head 3 and fluid line 5 are shown schematically in the figure in a section along the longitudinal burner axis A.

The burner 1 includes a main burner system having an annular air supply channel 9 and a fuel supply system 11 with fuel nozzles 13 that lead into the air supply channel 9. The fuel is introduced via a fuel supply line 15 of the fuel supply system 11 into an annular space 17 annularly surrounding the longitudinal burner axis A, from where it is finally distributed among the fuel nozzles 13. Basically any combustible gases or liquids, but in particular heating oil, are possible fuels.

The burner is embodied as what is termed a premix burner wherein prior to burning the fuel is sprayed into an air stream flowing through the air supply channel 9. When the burner is being operated, particularly with heating oil as the fuel fluid, what occurs throughout the fuel supply system 11 is soiling and coking that can result particularly in clogging of the nozzle openings.

In addition to the main burner system 7 the burner includes a further burner system located in the interior 19 of the main burner system 7. The further burner system is not shown in the figure. It can include, for example, a pilot burner system.

Shown in FIG. 1 apart from the burner 1 are the rinsing head 3 and fluid line 5 of a burner cleaning system. The rinsing head 3 is in the present exemplary embodiment embodied as rotationally symmetrical and includes a wall 21 that is shaped like a cylinder envelope or the shell of a truncated cone and through whose interior rinsing fluid channels 23 are ducted to a frontal area 25 of the wall 21. The frontal area 25 circumscribes an opening in the front face of the hollow cylinder or, as the case may be, truncated cone formed by the wall 21. Connected to the end, opposite said opening, of the wall 21 is an end wall 26 through which the channels 23 are further ducted up to a central region 27 of the end wall 26. A rinsing fluid line 29 leads into the central region 27. Rinsing fluid can be ducted to or from the rinsing head 3 via the rinsing fluid line 29.

The rinsing head 3 is embodied such that it can be inserted through the discharge opening 31 of the burner 1 up to the fuel nozzles 13 into the air supply channel 9. The geometry of the wall 21 is selected such that the frontal area 25 can be placed onto the fuel nozzles 13 arranged annularly inside the air supply channel 9 around the longitudinal burner axis A. In the frontal area 25 there are furthermore rinsing fluid discharge openings 33 that are arranged in the frontal area 25 such as to align with the fuel nozzles 13 when the rinsing head 3 has been inserted into the burner 1. Arranged around the rinsing fluid openings 33 are seals 35 that seal the air supply channel 9 from rinsing fluid flowing through the openings 33 and nozzles 13. The sealing effect is in the present exemplary embodiment increased by means of compression springs 36 arranged on the exterior of the rinsing head 3 and acting as tensioning elements between the rinsing head 3 and the wall 38, opposite the nozzle openings 13, of the air supply channel 9. The compression springs 36 also ensure that the rinsing head is secured into position on the burner 1. Alternative embodiments of the tensioning elements, for example as a hasp on the burner 1, as a tensioning lever, etc., are also possible.

Rinsing fluid can then be flushed into the fuel supply system 11 via the rinsing head 3 and fluid line 29. The rinsing fluid can then exit the fuel supply system 11 again through the annular space 17 and fuel supply line 15. The entire fuel supply system can in that way be rinsed by means of the rinsing head 3. The rinsing fluid flowing through the fuel supply system 11 will flush therefrom any dirt or coking that arises therein particularly in the region of the fuel nozzles 13 and is disruptive. The rinsing fluid exiting the fuel supply system 11 via the fuel supply line 15 can be collected. In particular demineralized water or a solvent can be used as rinsing fluid.

The burner cleaning device furthermore includes a pump 37, not shown in FIG. 1 (see FIGS. 2-4), with the aid of which the rinsing fluid is pumped through the fuel supply system 11.

Although it is basically possible to safely dispose of the rinsing fluid exiting the fuel supply system 11 along with the dirt contained therein, a closed rinsing circuit is used in the present exemplary embodiment. Connected to the fuel supply line 15 is a fluid line 5 that ducts the rinsing fluid exiting the fuel supply system 11 to a filter 39, where the dirt carried away by the rinsing fluid is filtered out. After flowing through the filter the rinsing fluid is collected in a tank, from where it is fed back to the rinsing head 3 by means of the pump.

Figure 2:
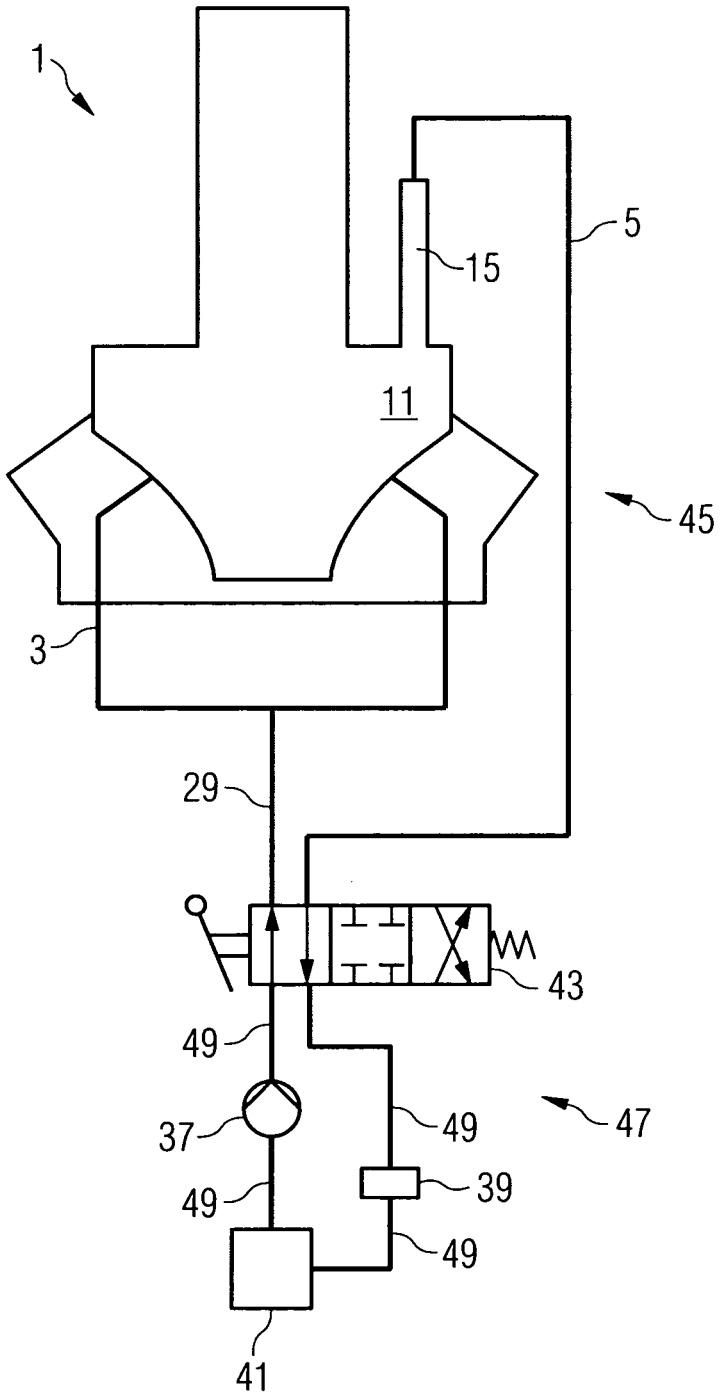
FIG. 2 is a hydraulic diagram of the burner cleaning device having a valve in a first valve position.
Figure 3:
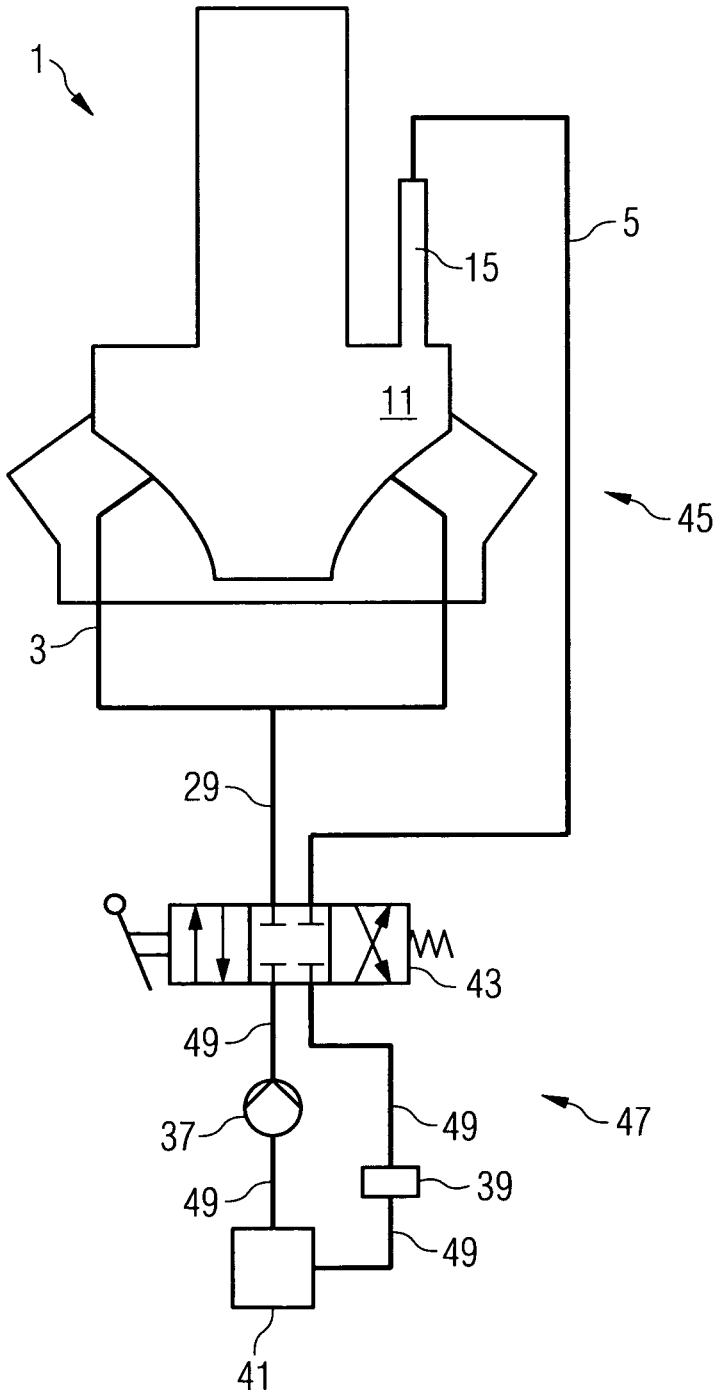
FIG. 3 is the hydraulic diagram shown in FIG. 2 having a valve in a second valve position.
Figure 4:
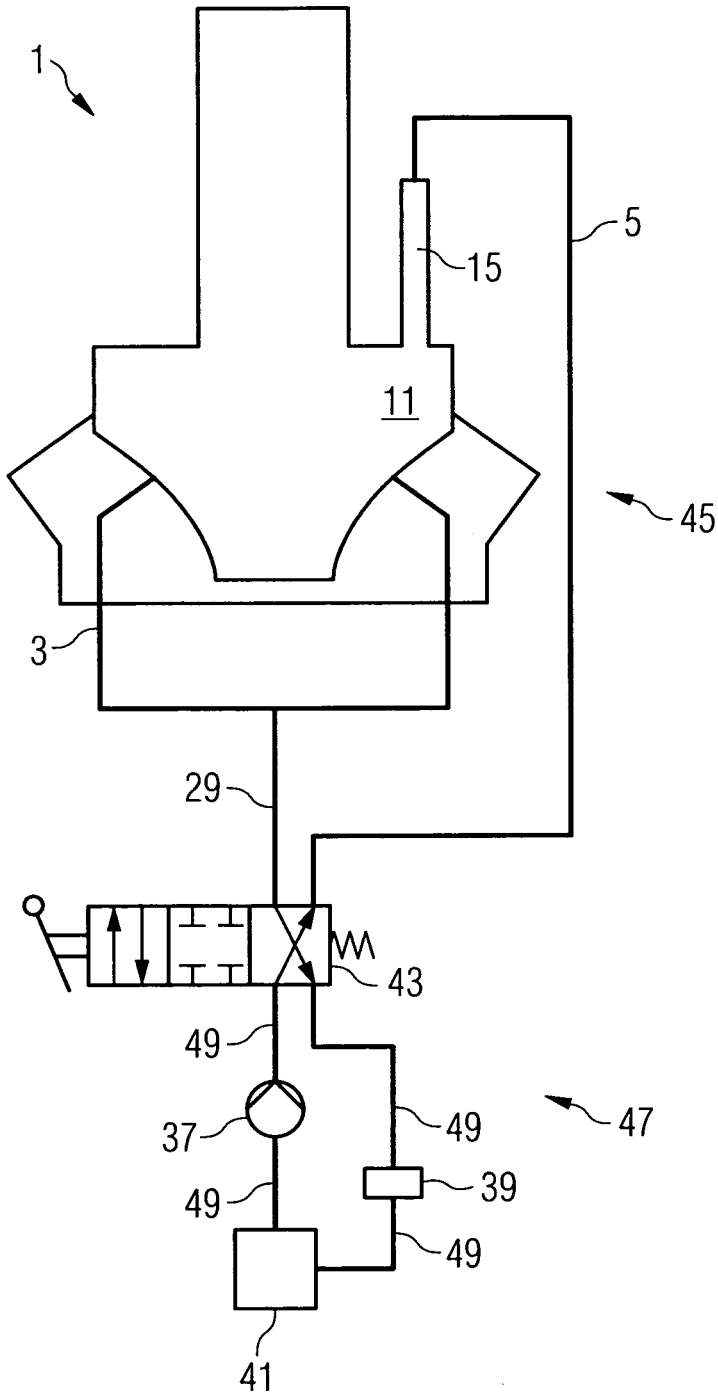
FIG. 4 is the hydraulic diagram shown in FIG. 2 having a valve in a third valve position.

The rinsing circuit is presented in FIGS. 2-4 in the form of a hydraulic diagram. Shown in the hydraulic diagram alongside the rinsing head 3 and fluid line 5 are also the pump 37, the filter 39, the tank 41, and a valve 43. In the present exemplary embodiment the valve 43 is embodied as a manually actuated mid-position closed 4/3 directional valve. It can, though, also be embodied as an electrically actuated valve, for example as a solenoid valve.

Together with the fuel supply system 11 of the burner 1, the rinsing head 3, fluid line 5, pump 37, filter 39, tank 41 and valve 43 form, as already mentioned, a closed fluid circuit. The fluid circuit has a first section 45 that includes the rinsing head 3, the rinsing fluid line 29 leading to the rinsing head 3, the fluid line 5 and the fuel supply system 11 of the burner 1. It also has a second section 47 that includes the pump 37, the filter 39, the tank 41 and fluid lines 49 linking said elements to each other. Located between the first section 45 and second section 47 is the mid-position closed 4/3 directional valve 43.

When the valve is in the position shown in FIG. 2 the rinsing fluid flows, proceeding from the pump 37, into the rinsing head 3 and through the fuel supply system 11, the fluid line 5 and the filter 39 into the tank 41, from where the pump 37 pumps it back into the rinsing head 3. The floating particles resulting from cleaning of the fuel supply system 11 are therein filtered out of the rinsing fluid in the filter 39.

It can be of practical advantage to reverse the flow direction of the cooling fluid flowing through the first section 45 of the fluid circuit. To achieve that, the valve 43 is moved via a valve position in which the fluid circuit is interrupted (see FIG. 3) to a valve position in which the flow conditions in the first section 45 are reversed compared with the valve position shown in FIG. 2. The flow conditions in the second section 47 will, conversely, remain unchanged. Reversing the rinsing direction can, for example, prevent residues unable to be rinsed out of the fuel supply system 11 in one rinsing direction from still remaining in the fuel supply system 11 after cleaning.

Because fluid always flows through the second section 47 of the rinsing circuit in the same direction, dirt filtered out by the filter when fluid is flowing in one direction can be prevented from being carried back into the fuel supply system when fluid is flowing in the other direction. The pump 37, which can be embodied as a pressure or suction pump, furthermore needs only to be able to pump in one direction.

As already indicated above, instead of with a closed rinsing circuit the burner cleaning device can be operated with an open rinsing path. In that case it is possible either for rinsing fluid to be fed via the rinsing head 3 to the fuel supply system 11 and then exit it through the fuel supply line 15 and be safely disposed of or, alternatively, for the rinsing fluid to be fed via the fluid line 5. After flowing through the fuel supply system 11, the rinsing fluid will then exit the fuel nozzles 13 and can be collected and safely disposed of after exiting. A closed rinsing circuit is, though, advantageous in terms of rinsing fluid consumption and from an ecological viewpoint.

In the exemplary embodiment described, all the rinsing fluid channels 23 were arranged in a common wall 21 matched to the burner 1 requiring to be cleaned. It is, though, also possible to fit the rinsing head with a number of supply lines in the form of, for instance, hoses or pipes placed individually onto the fuel nozzles 13. The advantage thereof is that the rinsing head can be operated in conjunction with different burners mutually differing with respect to, for example, the number of fuel nozzles or their positioning. However, the embodiment variant described having the embodiment of the rinsing head 3 specifically matched to the burner has the advantage of allowing the burner to be cleaned automatically because rinsing hoses will not have to be placed manually onto the fuel nozzles 13.

Figure 5:
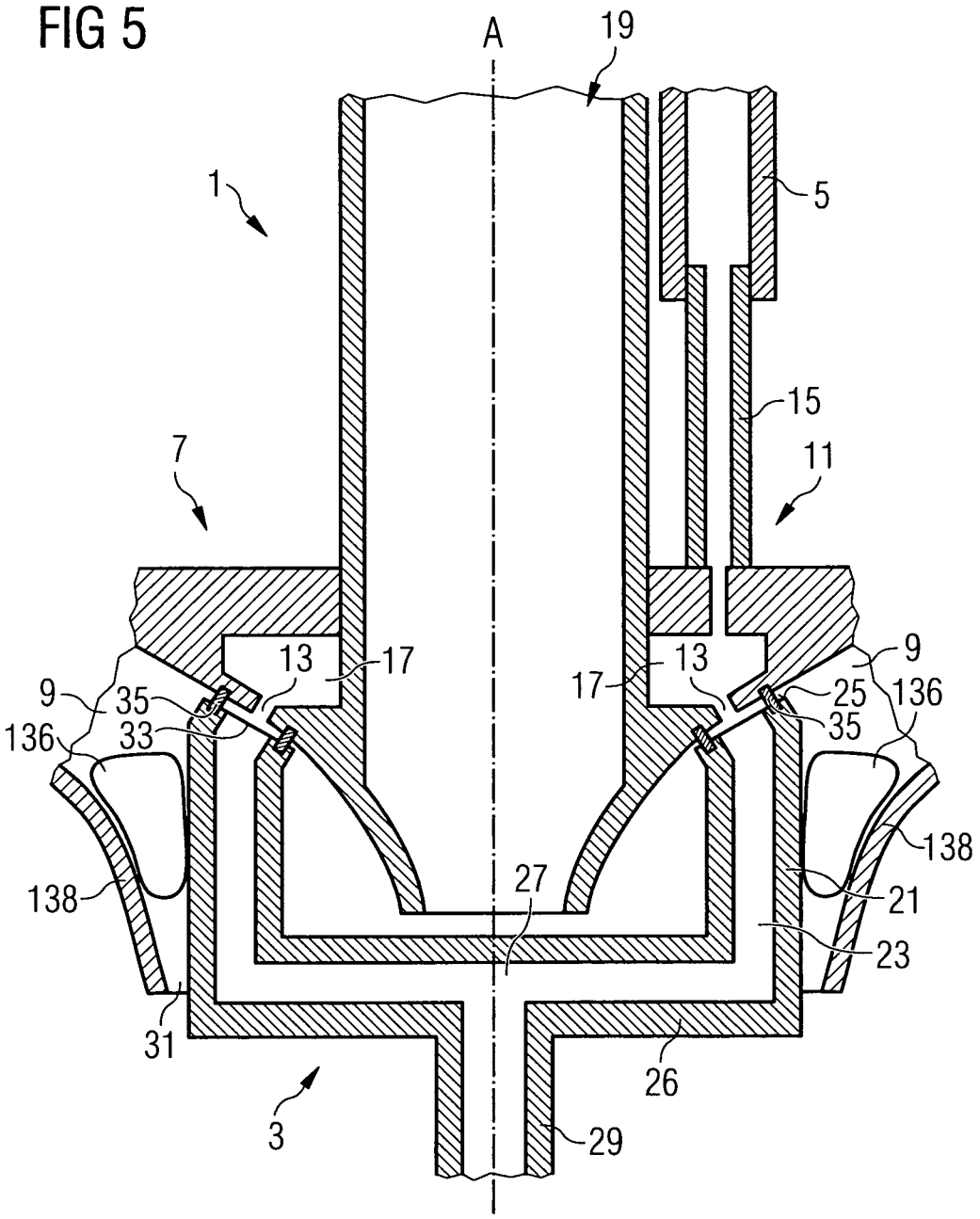
FIG. 5 shows a second exemplary embodiment of the burner cleaning device.

A second exemplary embodiment for the burner cleaning device is shown in FIG. 5. Said burner cleaning device differs from the burner cleaning device shown in FIG. 1 only in employing an inflatable hose 136 running round the exterior of the wall 21 instead of compression springs as pressure producing devices. The dimensions of the hose 136 in the inflated condition are such that it will fit snugly against the interior of the outer wall 138 of the air supply channel 9 and exert pressure against the wall 138. The hose 136 is inflated using a suitable fluid, for example air or water. The rinsing head 3 is pressed toward the nozzle openings 13 and held in position by the pressure exerted. The force with which the rinsing head 3 is pressed against the nozzle openings 13 can be set by the pressure of the fluid inside the hose 136. The hose can in particular also be matched in its geometry to the shape of the space between the rinsing head 3 and the outer wall 138 of the air supply channel 9. The burner cleaning device in the second exemplary embodiment is incidentally no different from that in the first exemplary embodiment.

The burner cleaning device makes it possible to dispense with time-consuming manual cleaning of the burner. In particular the burner cleaning device will enable cleaning of the burner to be extensively automated. Time and money can be saved thereby when the burner is cleaned.

The invention claimed is:

1. A burner cleaning device for cleaning burners, each burner including a fuel nozzle and a fuel supply line leading to the fuel nozzle, comprising:

a rinsing head with a rinsing head opening;

a fluid line; and a pump, wherein the pump, the rinsing head and the fluid line are fluidically interconnected such as to form a flow path along which a rinsing fluid sequentially flows, wherein the rinsing head is placeable by the rinsing head opening onto the fuel nozzle of a burner and enables the rinsing fluid to be fed to or evacuated from the fuel nozzle, wherein the fluid line of the cleaning device is connectable to the fuel supply line of the burner and enables the rinsing fluid to be fed to or evacuated from the fuel supply line such that an entire fuel supply system of the burner is cleaned, and wherein the rinsing head is insertable through a discharge opening of the burner up to a fuel nozzle opening out in an air supply channel of the burner, wherein the rinsing head includes a tensioning device by which the rinsing head is tensionable against a wall of the air supply channel disposed opposite the fuel nozzle opening, and wherein the rinsing head is provided with a seal that surrounds the rinsing head opening and is embodied and arranged on the rinsing head such as to surround the fuel nozzle opening when the rinsing head has been placed onto the fuel nozzle.

2. The burner cleaning device as claimed in claim 1, wherein the device is for cleaning gas turbine burners.

3. The burner cleaning device as claimed in claim 1, wherein the rinsing head includes a wall that is cylindrical or shaped like a truncated cone, and wherein the tensioning device is a pressure producing device located on the exterior of the wall.

4. The burner cleaning device as claimed in claim 3, wherein the pressure producing device is a compression spring.

5. The burner cleaning device as claimed in claim 3, wherein the pressure producing device is an inflatable hose.

6. The burner cleaning device as claimed in claim 1, further comprising:

a filter connected into the flow path.

7. The burner cleaning device as claimed in claim 1, further comprising:

a tank connected into the flow path.

8. The burner cleaning device as claimed in claim 1, further comprising:

a valve connected into the flow path.

9. The burner cleaning device as claimed in claim 8, wherein the flow path leads back to the valve and the valve has at least two valve positions releasing the flow path, wherein the rinsing fluid's flow direction through the rinsing head and fluid line is in one releasing valve position opposite the flow direction in the other releasing valve position.

10. The burner cleaning device as claimed in claim 7, wherein the flow path has a section through which fluid always flows in the same flow direction regardless of the releasing valve position and in which the filter is located.

11. The burner cleaning device as claimed in claim 8, wherein the flow path has a section through which fluid always flows in the same flow direction regardless of the releasing valve position and in which the filter is located.

12. The burner cleaning device as claimed in claim 1, wherein the rinsing fluid has demineralized water or a solvent.

* * * * *